US009199463B2

(12) United States Patent
Nishikawa

(10) Patent No.: US 9,199,463 B2
(45) Date of Patent: Dec. 1, 2015

(54) LIQUID DISCHARGE HEAD

(71) Applicant: Brother Kogyo Kabushiki Kaisha, Nagoya-shi, Aichi-ken (JP)

(72) Inventor: Yasuo Nishikawa, Nagoya (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 14/602,365

(22) Filed: Jan. 22, 2015

(65) Prior Publication Data

US 2015/0210075 A1 Jul. 30, 2015

(30) Foreign Application Priority Data

Jan. 24, 2014 (JP) ..... 2014-010897

(51) Int. Cl.
*B41J 2/15* (2006.01)
*B41J 2/14* (2006.01)

(52) U.S. Cl.
CPC ..... *B41J 2/1433* (2013.01); *B41J 2002/14491* (2013.01)

(58) Field of Classification Search
CPC .... B41J 2202/20; B41J 2202/19; B41J 2/145; B41J 2002/14362
See application file for complete search history.

(56) References Cited

U.S. PATENT DOCUMENTS

| | | | | |
|---|---|---|---|---|
| 7,252,362 | B2 | 8/2007 | Katsu et al. | |
| 8,608,283 | B1 * | 12/2013 | Phillips et al. | 347/43 |
| 2002/0041310 | A1 | 4/2002 | Kaneko et al. | |

FOREIGN PATENT DOCUMENTS

| | | |
|---|---|---|
| JP | 2002-154208 | 5/2002 |
| JP | 4437337 | 1/2010 |

* cited by examiner

*Primary Examiner* — Lamson Nguyen
(74) *Attorney, Agent, or Firm* — Frommer Lawrence & Haug LLP

(57) ABSTRACT

There is provided a liquid discharge head including: a nozzle substrate including a semiconductor substrate as a base, a first liquid channel disposed inside the nozzle substrate to communicate with first nozzles, and a second liquid channel disposed inside the nozzle substrate to communicate with second nozzles; first and second energy applying mechanisms; and an electrical element provided on the semiconductor substrate to be electrically connected to the first and second energy applying mechanisms. A first nozzle row and a second nozzle row which extend in a arrangement direction are formed in the nozzle substrate. A length of the first nozzle row in the arrangement direction is longer than a length of the second nozzle row in the arrangement direction.

11 Claims, 12 Drawing Sheets

LIQUID DISCHARGE HEAD

CROSS REFERENCE TO RELATED APPLICATION

The present application claims priority from Japanese Patent Application No. 2014-010897, filed on Jan. 24, 2014, the disclosure of which is incorporated herein by reference in its entirety.

BACKGROUND

1. Field of the Invention

The present invention relates to a liquid discharge head to discharge liquid.

2. Description of the Related Art

An ink-jet head as an exemplary liquid discharge head which is used in an ink-jet printer is provided with color nozzle rows and black nozzle rows extending in a conveyance direction of a medium to be printed.

The black nozzle rows are formed of more nozzles than those of each of the color nozzle rows to be elongated in the conveyance direction. This configuration allows the ink-jet head to perform the printing using the black ink over a wider range than the printing using each color ink while the ink-jet head is moved once in the scanning direction. Therefore, monochrome printing using only the black ink can be performed faster than the color printing using each color ink, for example.

SUMMARY

The above ink-jet head, however, includes a color nozzle substrate and a black nozzle substrate provided independently from each other, the color nozzle substrate having the color nozzle rows formed therein, the black nozzle substrate having the black nozzle rows formed therein. In a case that a drive circuit is incorporated into the nozzle substrate, the drive circuit via which the ink is discharged by driving the energy generating mechanism is required to be provided independently for each of the color nozzle substrate and the black nozzle substrate. Thus, the conventional inkjet head has such a problem that the total area of a color nozzle substrate area and a black nozzle substrate area becomes large to result in a larger inkjet head.

An object of the present teaching is to provide a downsized liquid discharge head in which color nozzle rows and black nozzle rows are disposed in one nozzle substrate to share an electrical element such as a drive circuit.

According to an aspect of the present teaching, there is provided a liquid discharge head configured to discharge liquid to a medium including:

a nozzle substrate formed integrally with a semiconductor substrate as a base, and in which a first liquid channel and a second liquid channel are formed, the first liquid channel being disposed inside the nozzle substrate to communicate with a plurality of first nozzles from which a first liquid supplied from a liquid supply source is discharged, the second liquid channel being disposed inside the nozzle substrate to communicate with a plurality of second nozzles from which a second liquid different from the first liquid and supplied from the liquid supply source is discharged;

a plurality of first energy applying mechanisms provided in the first liquid channel to correspond to the first nozzles respectively on the semiconductor substrate and configured to apply energy to discharge the first liquid from the first nozzles to the first liquid;

a plurality of second energy applying mechanisms provided in the second liquid channel to correspond to the second nozzles respectively on the semiconductor substrate and configured to apply energy to discharge the second liquid from the second nozzles to the second liquid; and an electrical element provided on the semiconductor substrate to be electrically connected to the first energy applying mechanisms and the second energy applying mechanisms, wherein the first nozzles are arranged in an arrangement direction to form a first nozzle row and the second nozzles are arranged in the arrangement direction to form a second nozzle row in the nozzle substrate;

the first nozzle row and the second nozzle row are arranged side by side in a row-alignment direction perpendicular to the arrangement direction; and a length of the first nozzle row in the arrangement direction is longer than a length of the second nozzle row in the arrangement direction.

DESCRIPTION OF THE PREFERRED EMBODIMENT

Figure 1:
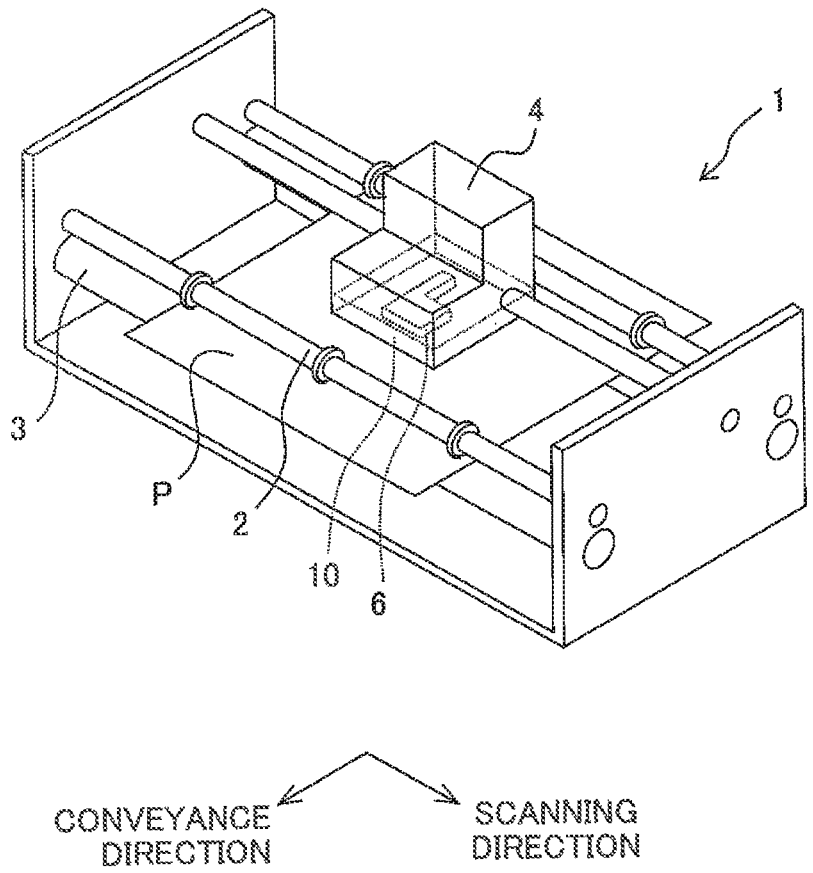
FIG. 1 depicts a schematic configuration of an ink-jet printer 1.

Hereinbelow, an embodiment of the present teaching will be explained with reference to the drawings. First, a schematic configuration of an ink-jet printer 1 which has an ink-jet head 10 as a liquid discharge head according to the present teaching will be explained. The ink-jet printer 1 depicted in FIG. 1 is a printer in which ink droplets are discharged onto a recording sheet P from the ink-jet head 10 provided in a carriage 4 to form letters, images, and the like on the recording sheet P. The ink-jet printer 1 includes a conveyance roller 2, a platen roller 3, the carriage 4, the ink-jet head 10, and the like. The conveyance roller 2 is rotationally driven to fed or send the recording sheet P while nipping the recoding sheet P between the conveyance roller 2 and the platen roller 3 so as to convey the recording sheet P in a casing of the ink-jet printer 1 in a conveyance direction (for example, a direction of a horizontal direction).

The carriage 4 is disposed in the casing, for example, at a position facing a conveyance surface of the recording sheet P as viewed from above. The carriage 4 reciprocates in a scanning direction perpendicular to the conveyance direction. The carriage 4 has, on a surface (for example, a lower surface) facing the sheet surface of the recording sheet P, the ink-jet head 10 which discharges inks from a plurality of nozzle ports 61C, 61M, 61Y, and 61K (see FIG. 2). Although details will be described later, the ink-jet head 10 is a head unit in which a nozzle substrate 6 of a semiconductor chip type is incorporated. The nozzle substrate 6 includes a semiconductor substrate 11 (see FIG. 3) used as a base, nozzles from which inks are discharged, elements which generate energy to discharge inks from the nozzles, a drive circuit to drive the elements, and the like. The ink-jet head 10 is attached to a lower part of the carriage 4 in a state of incorporating the nozzle substrate 6 therein. The nozzle substrate 6 is incorporated in the ink-jet head 10 so that an ink supply surface 18 (see FIG. 3) faces upward, the ink supply surface 18 being a surface to which inks are supplied and being provided on the side opposite to an ink-jetting surface 71 (see FIG. 3) on which the nozzle ports 61C, 61M, 61Y, and 61K are open. Cartridges (not depicted) containing respective inks of cyan (C), magenta (M), yellow (Y), and black (Bk) are installed to the ink-jet printer 1, and the inks are supplied to the ink-jet head 10.

In the ink-jet printer 1, the carriage 4 is driven to be reciprocally moved in the scanning direction while the conveyance roller 2 and the platen roller 3 are rotationally driven to convey the recording sheet P in the conveyance direction. The carriage 4 moves in a direction parallel relatively to the sheet surface of the recording sheet P. The inks supplied from the cartridges are jetted from the ink-jet head 10 provided in the carriage 4 to form letters, images, and the like on the sheet surface of the recording sheet P. The recording sheet P having letters, images, and the like thereon is discharged from the casing by the conveyance roller 2 and the platen roller 3.

Figure 3:
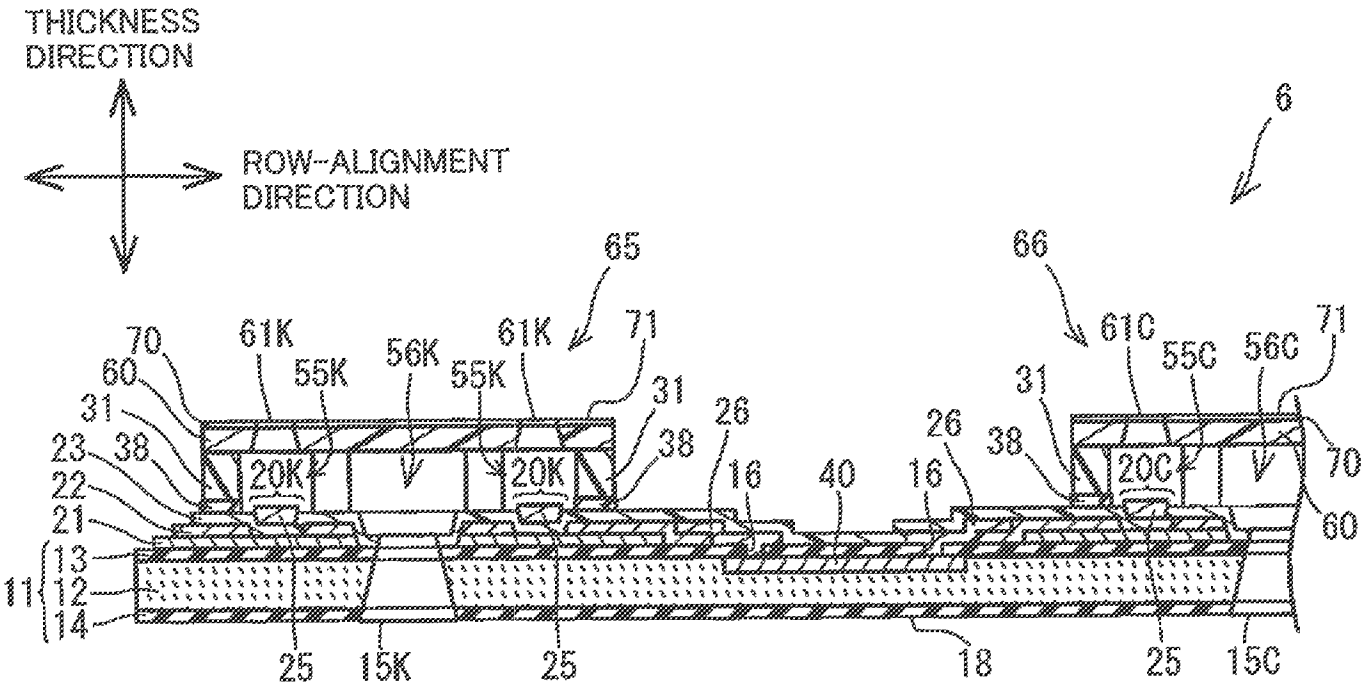
FIG. 3 is a cross-sectional view of the ink-jet head 10 taken along the line III-III in FIG. 2 as viewed in the direction indicated by arrows.

Subsequently, an explanation will be made in detail about the configuration of the nozzle substrate 6 provided for the inkjet head 10. The nozzle substrate 6 is formed of a plurality of members which are stacked with each other to form layers. In the following, a thickness direction of the layers constituting the nozzle substrate 6 is defined as an up-down direction as depicted in FIG. 3. The side on which the ink-jetting surface 71 is provided is defined as the upper side; and the side on which the ink supply surface 18 is provided is defined as the lower side.

Figure 2:
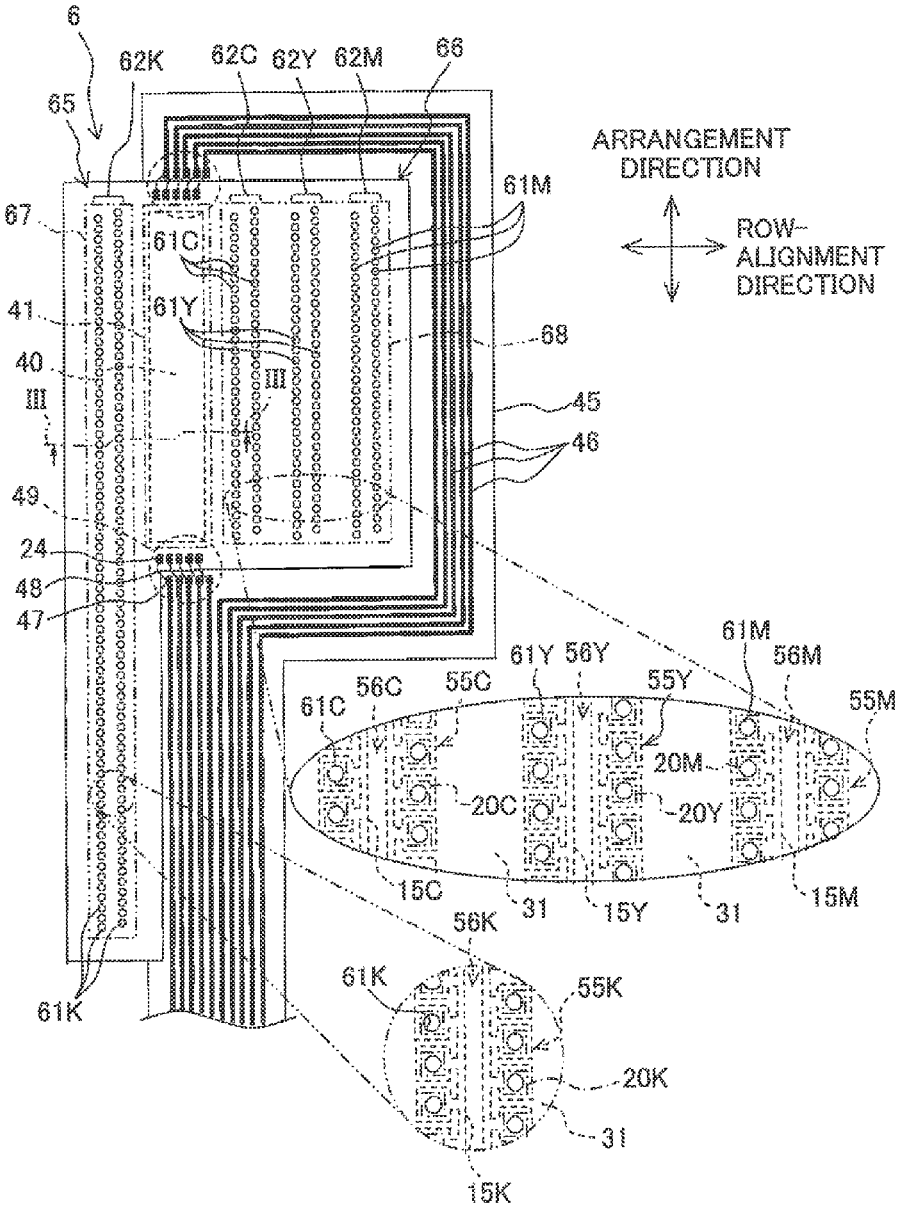
FIG. 2 depicts an ink-jetting surface 71 of an ink-jet head 10.

The nozzle substrate 6 as depicted in FIGS. 2 and 3 is the substrate of the semiconductor chip type as described above. The nozzle substrate 6 includes a black nozzle unit 65 and a color nozzle unit 66 in an integrated manner. The black nozzle unit 65 is a part in which an ink channel 56K, which is formed inside the black nozzle unit 65 and which communicates with the nozzle ports 61K from which the black ink is discharged, is formed on the semiconductor substrate 11 as the base. The nozzle ports 61K are arranged to form two rows in one direction (a direction in which the ports are arranged in rows, hereinafter referred to as "arrangement direction"), thereby forming nozzle rows 62K. A direction which is orthogonal to the arrangement direction and in which the two nozzle rows 62K are arranged side by side is hereinafter referred to as "row-alignment direction". In a case that the inkjet head 10 incorporating the nozzle substrate 6 therein is attached to the carriage 4 (see FIG. 1), the arrangement direction coincides with the conveyance direction of the ink-jet printer 1 and the row-alignment direction coincides with the scanning direction. The ink channel 56K communicates with ink chambers 55K corresponding to the nozzle ports 61K respectively, each of the ink chambers 55K is formed by being partitioned by a side wall 31, a nozzle layer 60, and the like provided on the semiconductor substrate 11. Each of the nozzle ports 61K communicates with one of the ink chambers 55K. In each ink chamber 55, there is provided a heat generation unit 20K to function as an energy generating element which applies the energy for jetting ink to the ink. The heat generation unit 20K is a part configured as follows. That is, electrode layers 22, 26, each of which has a predetermined conducting pattern, are provided on a heat generation resistant layer 21 to cause current to flow in the heat generation resistant layer 21, thereby making it possible to generate heat.

The color nozzle unit 66 is a part in which ink channels 56C, 56M, and 56Y which are formed inside the color nozzle unit 66 and which respectively communicate with the nozzle ports 61C, 61M, and, 61Y from which the inks having cyan, magenta, and yellows colors are discharged respectively, are formed on the semiconductor substrate 11 shared with the black nozzle unit 65. Similar to the nozzle ports 61K, the nozzle ports 61C, 61M, and 61Y are each arranged to form two rows in the arrangement direction, thereby forming nozzle rows 62C, 62M, and 62Y respectively. In the color nozzle unit 66, the nozzle rows 62C, 62M, and 62Y are arranged side by side in the row-alignment direction so that these rows are parallel to the nozzle rows 62K of the black nozzle unit 65 in the row-alignment direction. Like the ink channel 56K, the ink channels 56C, 56M, and 56Y communicate with ink chambers 55C, 55M, and 55Y respectively. The ink chambers 55C, 55M, and 55Y correspond to the nozzle ports 61C, 61M, and 61Y respectively. Each of the ink chambers 55C, 55M, and 55Y is formed by being partitioned by the side wall 31, the nozzle layer 60, and the like. Each of the nozzle ports 61C, 61M, and 61Y communicates with one of the ink chambers 55C, 55M, and 55Y. In the ink chambers 55C, 55M, and 55Y, heat generation units 20C, 20M, and 20Y are provided respectively.

Ink openings 15C, 15M, 15Y, and 15K are respectively open in the ink supply surface 18 of the nozzle substrate 6. Each of the ink openings 15C, 15M, 15Y, and 15K is connected to one of the ink channels 56C, 56M, 56Y, and 56K in the nozzle substrate 6. The inks of cyan, magenta, yellow, and black are supplied from cartridges (not depicted) to the ink chambers 55C, 55M, 55Y, and 55K communicating with the ink channels 56C, 56M, 56Y, and 56K via the ink openings 15C, 15M, 15Y, and 15K, respectively. Bubbles are generated in the inks supplied to the ink chambers 55C, 55M, 55Y, and 55K by heating the inks with the heat generation units 20C, 20M, 20Y, and 20K. The inks in the ink chambers 55C, 55M, 55Y, and 55K are pushed out by the bubbles, so that the inks are discharged from the nozzle ports 61C, 61M, 61Y, and 61K respectively.

As described above, the nozzle substrate 6 has a layered structure. As depicted in FIG. 3, the nozzle substrate 6 is configured such that the semiconductor substrate 11, the heat generation resistant layer 21, the electrode layers 22, 26, a protection layer 23, the side wall 31, the nozzle layer 60, and a water repellent layer 70 are primarily stacked in this order from the side of the ink supply surface 18 to the side of the ink jetting surface 71 so as to form the layered structure. The ink openings 15C, 15M, 15Y, and 15K are provided in the semiconductor substrate 11 and the protection layer 23. The ink chambers 55C, 55M, and 55Y are each formed by being partitioned by the semiconductor substrate 11, the heat generation resistant layer 21, the electrode layers 22, 26, the protection layer 23, the side wall 31, and the nozzle layer 60. The inks of cyan, magenta, yellow, and black are supplied into the ink chambers 55C, 55M, 55Y, and 55K from the side of the ink supply surface 18 via the ink openings 15C, 15M, 15Y, and 15K, respectively. In the following, an explanation will be made about the structure of each layer of the nozzle substrate 6.

The nozzle substrate 6 includes the semiconductor substrate 11. The semiconductor substrate 11 is a substrate in which insulating layers 13, 14 are respectively formed on both sides of a silicon base 12 having a plate shape. Each of the insulating layers 13, 14 is made of a film of silicon oxide and has insulating function and heat storage function. On the upper surface side of the base 12, a transistor, a diode, a capacitor, and the like are made by the semiconductor process technology to form a drive circuit 40 which will be described later. A plurality of via holes 16 are formed to penetrate through the insulating layer 13 in the thickness direction at positions at which the drive circuit 40 is formed adjacently thereto. The heat generation resistant layer 21 including, for example, tantalum nitride (TaN) or tantalum aluminum (TaAl) is formed on the upper surface of the insulating layer 13 of the semiconductor substrate 11. The heat generation resistant layer 21 is provided on the insulating layer 13 so as not to overlap with parts where the ink openings 15C, 15M, 15Y, and 15K and the drive circuit 40 are formed. The lower surface of the insulating layer 14 of the semiconductor substrate 11 is the ink supply surface 18 of the nozzle substrate 6. The wording "the layer is formed on the surface" means not only that the layer is formed on the surface of each layer while being brought into contact directly therewith" but also that the layer is formed to sandwich any structure between itself and the surface of each layer.

The electrode layer 22 including, for example, gold (Au); Titanium (Ti), aluminum (Al), or aluminum alloy is formed on the heat generation resistant layer 21. The electrode layer 22 is formed in contact with the heat generation resistant layer 21. The electrode layer 22 has conduction resistance or current-carrying resistance lower than that of the heat generation resistant layer 21. The electrode layer 22 forms a wiring pattern from which predetermined parts formed with the heat generation units 20C, 20M, 20Y, and 20K are removed. The electrode layer 26 is formed to overlap with some parts of the electrode layer 22. The electrode layer 26 forms a wiring pattern which is connected to the drive circuit 40 via the wiring pattern of the electrode layer 22 and the via holes 16 provided in the insulating layer 13. The current flowing from the drive circuit 40 to the electrode layer 22 flows through parts, of the heat generation resistant layer 21, where energizing or conducting paths of the wiring pattern formed by the electrode layers 22, 26 are not connected, so that heat is generated at the parts of the heat generation resistant layer 21. That is, the parts which are provided separately from the wiring pattern formed by the electrode layers 22, 26 to make the current flow through the heat generation resistant layer 21 are the heat generation units 20C, 20M, 20Y, and 20K. The heat generation units 20C, 20M, 20Y, and 20K function as energy generating elements to apply the energy for jetting inks to the inks. The heat generation units 20C, 20M, 20Y, and 20K are provided to correspond to the positions where the nozzle ports 61C, 61M, 61Y, and 61K are formed, respectively. Similar to the nozzle ports 61C, 61M, 61Y, and 61K, each of the heat generation units 20C, 20M, 20Y, and 20K is aligned to form two rows (see FIG. 2).

The insulating protection layer 23 which includes, for example, silicon nitride is termed on the electrode layers 22, 26 and the heat generation resistant layer 21. The protection layer 23 protects the electrode layers 22, 26 and the heat generation resistant layer 21 from physical impact and chemical damages. The protection layer 23 is formed also on the insulating layer 13 of the semiconductor substrate 11 to cover a part of parts where no heat generation resistant layer 21 is provided. Further, the protection layer 23 also covers a part of the semiconductor substrate 11 where the drive circuit 40 is formed. The ink openings 15C, 15M, 15Y, and 15K are open to penetrate through the semiconductor substrate 11 and the protection layer 23 in the thickness direction (up-down direction) of the layers. The lower part of each of the ink openings 15C, 15M, 15Y, and 15K (the side of insulating layer 14) is formed to have an opening area larger than the upper part (the side of the protection layer 23) thereof. The ink openings 15C, 15M, 15Y, and 15K, each of which is open to have a rectangular shape, are respectively elongated between two rows of the nozzle ports 61C, 61M, 61Y, and 61K in planar view (see FIG. 2). A cavitation-resistant film 25 made of, for example, tantalum (Ta) is formed on the protection layer 23 at parts where the heat generation units 20C, 20M, 20Y, and 20K are provided. The cavitation-resistant film 25 protects the heat generation units 20C, 20M, 20Y, and 20K from impact and the like caused by bubbles that occur and fade in the ink chambers 55C, 55M, 55Y, and 55K (so-called "cavitation").

The side wall 31 made of, for example, epoxy resin is provided on the protection layer 23 via an adhesion layer 38. The adhesion layer 38 improves the adhesion property between the protection layer 23 and the side wall 31. The side wall 31 is provided upstandingly from the upper surface of the protection layer 23 toward the upper side in the thickness direction (toward the ink jetting surface 71). As depicted in FIG. 2, the side wall 31 forms the ink channels 56C, 56M, 56Y, and 56K through which the inks of cyan, magenta, yellow, and black supplied via the ink openings 15C, 15M, 15Y, and 15K flow respectively. As described above, the ink channels 56C, 56M, 56Y, and 56K are configured to respectively communicate with the ink chambers 55C, 55M, 55Y, and 55K which are formed by being partitioned to respectively surround the positions where the heat generation units 20C, 20M, 20Y, and 20K are formed.

As depicted in FIG. 3, the nozzle layer 60 made of, for example, epoxy resin or polyimide resin is formed on the side wall 31. The nozzle layer 60 covers the side wall 31 and the ink channels 56C, 56M, 56Y, and 56K formed by being surrounded by the side wall 31 therewith from above. The nozzle ports 61C, 61M, 61Y, and 61K are open to penetrate the nozzle layer 60 in the thickness direction of the layers while respectively corresponding to the ink chambers 55C, 55M, 55Y, and 55K. The nozzle ports 61C, 61M, 61Y, and 61K are each open to have a circular shape. The lower part of each of the nozzle ports 61C, 61M, 61Y, and 61K (the side of the ink chambers 55C, 55M, 55Y, and 55K) is formed to have an opening area larger than the upper part (the side of the ink jetting surface 71) thereof. The water repellent layer 70 made of a monomolecular film of a fluorine-containing compound is formed on the upper surface of the nozzle layer 60. The upper surface of the water repellent layer 70 is the ink jetting surface 71 of the nozzle substrate 6.

As depicted in FIG. 2, the nozzles are arranged at regular intervals and the number of nozzle ports 61K formed in the black nozzle unit 65 is greater than the number of each color of nozzle ports 61C, 61M, and 61Y formed in the color nozzle unit 66 on the nozzle substrate 6 of this embodiment. Thus, the nozzle rows 62K are longer than the nozzle rows 62C, 62M, and 62Y in the arrangement direction. The nozzle rows 62K and the nozzle rows 62C, 62M, and 62Y are provided in the black nozzle unit 65 and the color nozzle unit 66 respectively in a state that one ends of these rows in the arrangement direction are aligned. This configuration allows the other ends of the nozzle rows 62K to protrude beyond the other ends of the nozzle rows 62C, 62M, and 62Y in the arrangement direction.

The position on the semiconductor substrate 11 (see FIG. 3) in which the nozzle rows 62K, which are constructed of the nozzle ports 61K formed in the black nozzle unit 65, are formed is referred to as a first corresponding position 67. Further, the position on the semiconductor substrate 11 (see FIG. 3) in which the nozzle rows 62C, 62M, and 62Y, which are respectively constructed of the nozzle ports 61C, 61M, and 61Y formed in the color nozzle unit 66, are formed is referred to as a second corresponding position 68. As depicted in FIGS. 2 and 3, the drive circuit 40 is formed at the position, on the semiconductor substrate 11, which is positioned between the first corresponding position 67 and the second corresponding position 68 in the row-alignment direction and which does not overlap with the first corresponding position 67 and the second corresponding position 68 in the thickness direction.

The drive circuit 40 is a circuit unit which is formed on the semiconductor substrate 11 through the semiconductor process technology to have a known configuration including a logic circuit, an amplifier circuit, and the like. The logic circuit is an address circuit which designates from which nozzle port, of the nozzle ports 61C, 61M, 61Y, and 61K, each of the cyan, magenta, yellow, and black inks is discharged. The amplifier circuit is a circuit constructed of, for example, a transistor and a field effect transistor (FET). The amplifier circuit amplifies a signal outputted by the logical circuit (nozzle designation signal) to produce heat in each of the heat generation units 20C, 20M, 20Y, and 20K corresponding to one of the nozzle ports 61C, 61M, 61Y, and 61K designated by the logic circuit. The drive circuit 40 is electrically connected to respective heat generation units 20C, 20M, 20Y, and 20K via connecting lines (not depicted) forming the wiring pattern of the electrode layers 22, 26. Details of the circuits constructing the drive circuit 40 are omitted from the illustration. The part formed with the drive circuit 40 in the semiconductor substrate 11 is protected by being covered with the protection layer 23.

Since the drive circuit 40 is disposed on the semiconductor substrate 11 at the position between the first corresponding position 67 and the second corresponding position 68 in the row-alignment direction, it is possible to shorten lengths of wires (connecting lines) in the wiring pattern formed by the electrode layers 22, 26, the wires connecting the drive circuit 40 and the heat generation units 20C, 20M, 20Y, and 20K. This can reduce the conduction resistance in the electrode layers 22, 26. For example, it is possible to prevent the deterioration of the signal concerning the ink jetting such as the delay of waveform of the nozzle designation signal to be outputted by the logical circuit and the decrease in the voltage level to be applied to each of the heat generation units 20C, 20M, 20Y, and 20K by the amplifier circuit.

As depicted in FIG. 2, the nozzle substrate 6 includes a plurality of contact pads 24 on the upper surface of the insulating layer 13 of the semiconductor substrate 11 in the vicinity of a formation position 41 at which the drive circuit 40 is formed (in this embodiment, the contact pads 24 are provided adjacent to both ends of the drive circuit 40 in the arrangement direction). Each of the contact pads 24 is electrically connected to one of the circuits of the drive circuit 40 formed in the base 12 via each of the via holes (not depicted) formed in the insulating layer 13. In a case that the ink-jet head 10 incorporating the nozzle substrate 6 is attached to the carriage 4 (see FIG. 1), the drive circuit 40 is electrically connected to an external circuit via a flexible printed circuit (FPC) 45. A plurality of connecting lines 46 are provided in the FPC 45, and connection pads 47 are formed at respective ends of the connecting lines 46. The connection between the drive circuit 40 and the FPC 45 in the ink-jet head 10 is achieved through the wire bonding technology in which the contact pads 24 are connected to the connection pads 47 via bonding wires 48. After connection between the contact pads 24 and the connection pads 47 by use of the bonding wires 48, a connected part is protected by being entirely covered with a non-conducting resin 49. The electrical connection between the drive circuit 40 and the FPC 45 may be achieved, for example, by using an anisotropic conductive film (ACF) sandwiched between the contact pads 24 of the nozzle substrate 6 and the connection pads 47 of the FPC 45 under pressure.

Figure 4:
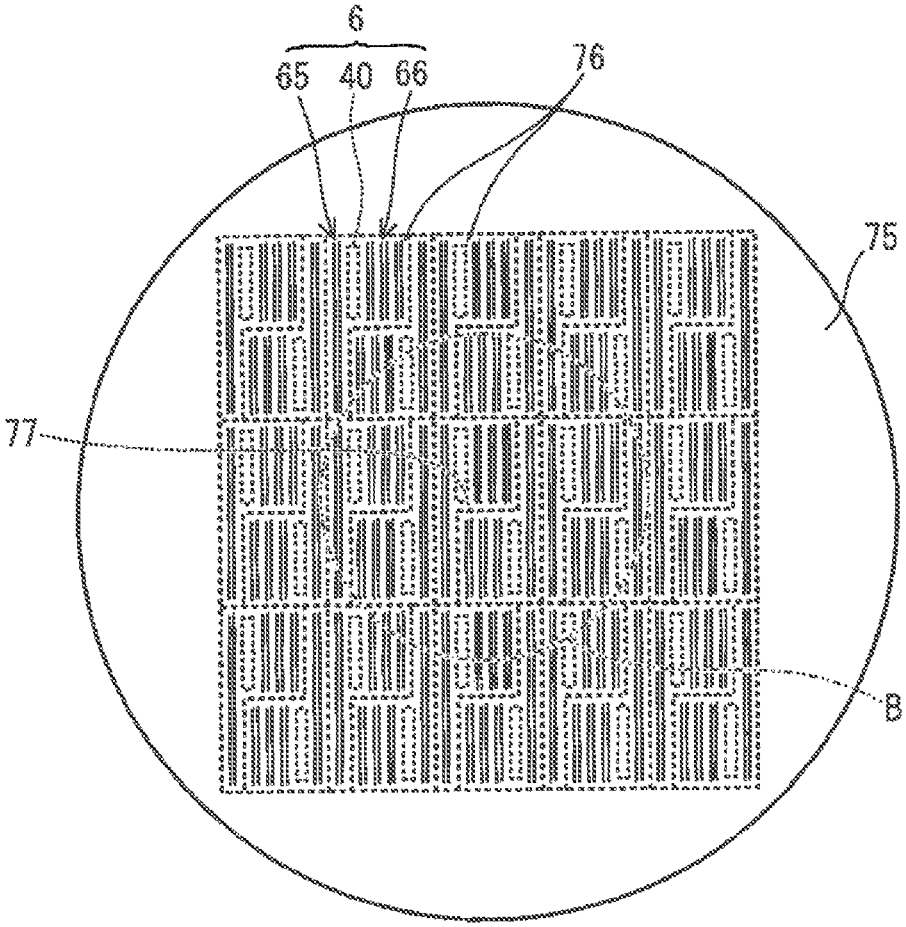
FIG. 4 depicts an exemplary arrangement of dies 76 constituting the ink-jet head 10 in a wafer 75.

The nozzle substrate 6 having the above configuration has a shape, in planar view, along the contour line which surrounds an area occupied by the first corresponding position 67, the second corresponding position 68, and the formation position 41 of the drive circuit 40. In this embodiment, the nozzle substrate 6 is formed to have a concave polygon shape in which an elongated rectangular area occupied by the first corresponding position 67 is connected to a side part, in the row-alignment direction, of a wide and short rectangular area occupied by the second corresponding position 68 and the drive circuit 40 so that one ends of respective rectangular areas in the arrangement direction are aligned. As depicted in FIG. 4, the nozzle substrate 6 is obtained by forming, on a wafer 75 of the semiconductor substrate 11, a plurality of dies 76 each of which is formed of a combination of the black nozzle unit 65, the color nozzle unit 66, and the drive circuit 40 and cutting each of the dies 76 to have the concave polygon shape. It is possible to increase the number of dies 76 which can be obtained from one wafer 75 by not only integrally forming the black nozzle unit 65 and the color nozzle unit 66 but also arranging the dies 76 each having the concave polygon shape in the form of blocks with no space therebetween with heating.

Figure 5:
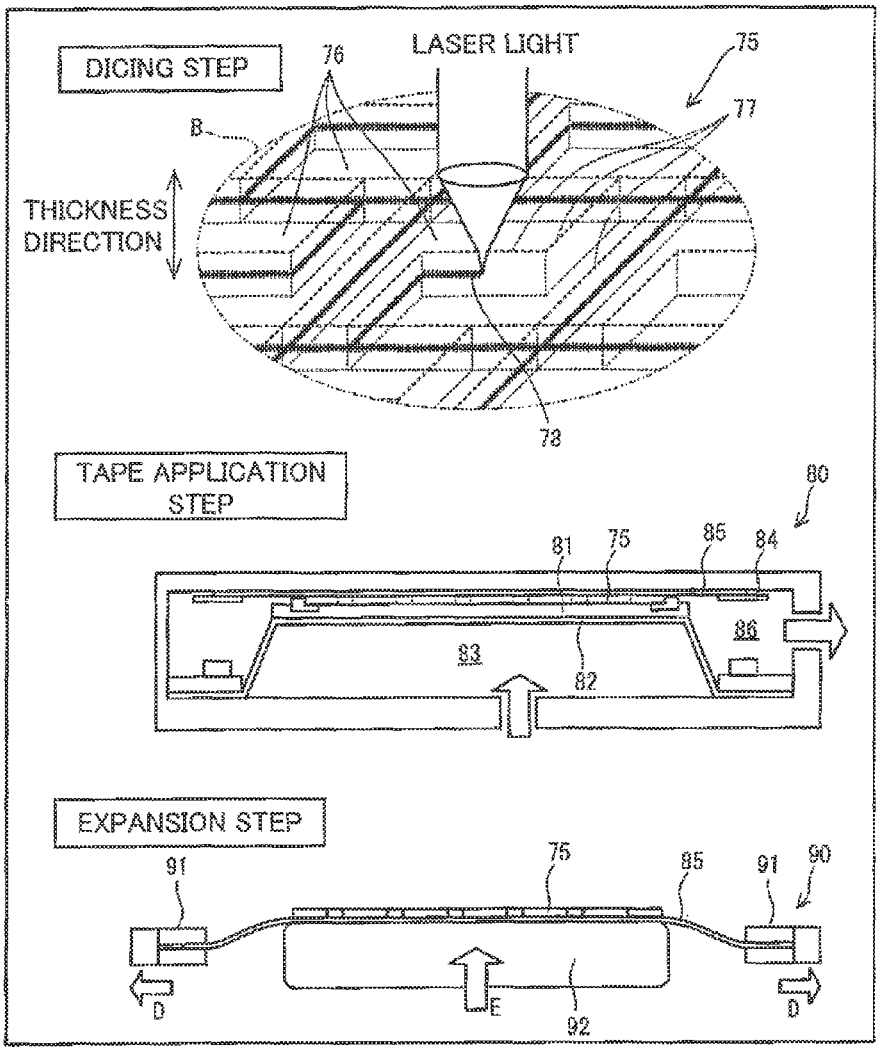
FIG. 5 illustrates steps of dicing in the manufacture of the ink-jet head 10.

In a case that a semiconductor wafer is cut by using a dicing saw, each die is formed to have a rectangular shape and is not formed concave polygon shape. In this case, an area where no nozzle ports are formed is created in each die, when the nozzle rows 62C, 62M, and 62Y and the nozzle rows 62K having a different length in the arrangement direction are formed in one die. This is because the semiconductor wafer must be cut in the rectangular shape when the semiconductor wafer is cut by the dicing saw. The area where no nozzle ports are formed could reduce the number of dies obtained from one wafer as compared with a case in which the nozzle rows 62K are formed independently from the nozzle rows 62C, 62M, and 62Y. Thus, the effect obtained when the nozzle rows 62K and the nozzle rows 62C, 62M, and 62Y are formed integrally is lessened. In view of this, in this embodiment, the wafer 75 is cut by laser dicing in which the wafer is cut by being irradiated with laser light along a cutting line 77, in order to obtain each die 76 having the concave polygon shape as depicted in FIGS. 4 and 5.

The preferred technology of the laser dicing is, for example, the stealth dicing (trademark) technology by Hamamatsu Photonics K.K. The cutting of the wafer 75 by the stealth dicing is performed in a dicing step (see FIG. 5) as follows. Noted that a part surrounded by two dot chain lines B in the dicing step of FIG. 5 is an enlarged perspective view of a part surrounded by two dot chain lines B of FIG. 4. The laser beam having the wavelength which has light permeability to the semiconductor wafer 75 is collected by an objective lens optical system to be focused on the inside of the wafer 75 (a substantially central part in the thickness direction). The laser beam is compressed in terms of time and space in the vicinity of the focus to form a peak power density state of which power is very high locally. Then, the absorption caused by the non-liner optical effect is generated at the inside of the wafer 75 only in the vicinity of the focus of the laser beam to apply the high energy to the wafer 75 only in the vicinity of the focus. Accordingly, by changing the relative position between the laser beam and the wafer 75 along the cutting line 77, the inside of the wafer 75 is locally and selectively laser-processed with no damages on the surface and the hack surface of the wafer 75, and thereby making it possible to form a crack 78 (see the technical document "stealth dicing technology and its application" by Hamamatsu Photonics K.K., issued on March, 2005).

In order to divide the wafer 75 having the crack 78 formed therein into individual dies 76 through the laser processing, it is used a known dividing method such that external stress such as tape expansion is applied to the wafer 75 to cause a growth of the crack in the wafer 75. First, as depicted in FIG. 5, there is performed, in a tape application step, a step in which a dicing tape 85 is applied on the wafer 75 for which the laser processing has been performed by use of a known tape applicator 80 (for example, a vacuum tape applicator produced by NEC Corporation). The dicing tape 85 is, for example, a UV tape. Since the stickiness of the UV tape decreases by irradiation with UV light, the wafer 75 can be easily released from the dicing tape 85. This makes it possible to prevent the damage of the water repellent layer 70, the nozzle layer 60, and the like of the nozzle substrate 6 in a case that each die 76 is peeled off from the dicing tape 85 after an expansion step which will be described later. As the dicing tape 85, it is possible to use, for example, UDV-80J, UDV-100J, UHP-0805MC, UHP-1005M3, UHP-1005AT, UHP-110AT, UHP-1101BZ, and UHP-110M3 those of which are produced by DENKA ADTECS CO., LTD.

The interior of the tape applicator 80 is partitioned by a rubber sheet 82, so that the tape applicator 80 has two chambers of a first chamber 83 and a second chamber 86. In the second chamber 86, the wafer 75 is placed on a jig or fixture 81 assembled on the rubber sheet 82. Further, frames 84 to which the dicing tape 85 is applied are positioned on the upper side of the wafer 75 in the second chamber 86. In a case that the second chamber 86 is depressurized and that the first chamber 83 is open to the atmosphere, the rubber sheet 82 expands by being pushed from the side of the first chamber 83 due to differential pressure. The rubber sheet 82 lifts the jig 81 in the second chamber 86 to make the wafer 75 tight contact with the dicing tape 85 positioned on the wafer 75. In a case that the second chamber 86 is open to the atmosphere, air is introduced into the second chamber 86, so that the pressure in the second chamber 86 gradually approaches atmospheric pressure. At this time, the pressure in the space between the dicing tape 85 and the upper surface of the tape applicator 80 approaches the atmospheric pressure earlier than the pressure in the space between the wafer 75 and the dicing tape 85. The differential pressure caused in this situation pushes the dicing tape 85 to the wafer 75, which causes the dicing tape 85 to be further brought in tight contact with the wafer 75. The wafer 75 to which the dicing tape 85 is applied is taken from the tape applicator 80.

Subsequently, there is performed, in the expansion step, a step in which the wafer 75 to which the dicing tape 85 is applied is divided into individual dies 76 by use of a known wafer expansion apparatus 90. The wafer 75 is positioned on the upper surface of the dicing tape 85 and ends of the dicing tape 85 are held by holding portions 91 of the wafer expansion apparatus 90. The wafer expansion apparatus 90 is provided with a pushing portion 92 which is disposed at the lower side of the wafer 75 to move upward. The wafer expansion apparatus 90 causes the holding portions 91 to horizontally move in directions away from the wafer 75 (directions indicated by the arrows D in FIG. 5) and causes the pushing portion 92 to move upward (the direction indicated by the arrow E in FIG. 5), thereby pushing the wafer 75 upward via the dicing tape 85. The stretching stress or tensile stress is uniformly applied to the wafer 75 from the wafer expansion apparatus 90 via the dicing tape 85. The wafer 75 is cleaved along the crack 78 formed in the wafer 75 through the stealth dicing, so that the wafer 75 is divided into individual dies 76. The dicing tape 85 is removed from the wafer expansion apparatus 90 and is irradiated with UV light to be peeled off from the dies 76. Accordingly, individual dies 76 are obtained. By performing the above steps, the nozzle substrate 6 having the concave polygon shape in planar view can be obtained from the wafer 75.

As described above, unlike the case in which the nozzle substrate is formed to have the rectangular shape, the area where no nozzle ports are formed is never created by forming the nozzle substrate 6, in which the nozzle rows 62C, 62M, and 62Y and the nozzle rows 62K having the different length from the nozzle rows 62C, 62M, and 62Y are formed integrally, to have the concave polygon shape in planar view. This can increase the number of dies 76 which can be obtained from one wafer 75, which results in the downsizing of the nozzle substrate 6. Further, by forming the nozzle rows 62K and the nozzle rows 62C, 62M, and 62Y integrally, the heat generation units 20K and the heat generation units 20C, 20M, and 20Y can be driven by one drive circuit 40. Thus, only one formation position 41 is required for the drive circuit 40, which can reduce the number of formation positions 41 as compared with the case in which two formation positions 41 are required by providing the nozzles rows 62K and the nozzle rows 62C, 62M, and 62Y separately. Accordingly, it is possible to increase the number of dies 76 which can be obtained from one wafer 75, and further it is possible to reduce the number of connecting lines 46 of the FPC 45 via which the nozzle substrate 6 and the external circuit are connected, to the number of connecting lines 46 required for the connection with one drive circuit 40. This allows the FPC 45 to have a narrower width, which results in the downsizing of the carriage 4 and the ink-jet printer 1.

As described above, in the ink jet head 10 according to this embodiment, the heat generation units 20K and the heat generation units 20C, 20M, and 20Y are driven by one drive circuit 40 provided in the nozzle substrate 6. Thus, the area occupied by the drive circuit 40 in the nozzle substrate 6 can be reduced as compared with the case in which the drive circuit for the heat generation units 20K is provided separately from the drive circuit for the heat generation units 20C, 20M, and 20Y. Further, it is possible to reduce the number of connecting lines 46 of the FPC 45 via which the drive circuit 40 and the external circuit are electrically connected. Thus, the ink-jet head 10 incorporating the nozzle substrate 6 can be downsized. Further, since the nozzle rows 62K and the nozzle rows 62C, 62M, and 62Y are formed in one nozzle substrate 6, it is possible to easily position the nozzle rows 62K and the nozzle rows 62C, 62M, and 62Y with respect to the FPC 45 with high accuracy. Therefore, in a case that the nozzle substrate 6 is incorporated into the ink-jet head 10, the nozzle rows 62K and the nozzle rows 62C, 62M, and 62Y can be easily positioned with respect to the inkjet head 10 with high accuracy. This can reduce the production costs of the ink-jet head 10.

Since the nozzle substrate 6 is configured to have a short distance in the row-alignment direction between the drive circuit 40 and each of the nozzle ports 61C, 61M, 61Y, and 61K, each of the wires (connecting lines) in the wiring pattern formed by the electrode layers 22, 26 can also have a short length. Each of the wires electrically connects the drive circuit 40 and one of the heat generation units 20C, 20M, 20Y, and 20K on the semiconductor substrate 11. This configuration can reduce the conduction resistance in the electrode layers 22, 26. Thus, the signal for jetting each of the inks of cyan, magenta, yellow, and black, which is outputted to one of the heat generation units 20C, 20M, 20Y, and 20K by the drive circuit 40, is prevented from deteriorating. As a result, each of the inks can be discharged with high accuracy without, for example, the delay of waveform of the signal.

By forming the nozzle substrate 6 to have the shape along the contour line surrounding the first corresponding position 67, the second corresponding position 68, and the drive circuit 40, the nozzle substrate 6 can be formed to have a small size, which results in the downsizing of the inkjet head 10.

The present teaching is not limited to the above embodiment, various modifications and changes may be made. In the nozzle substrate 6, each of the electrode layers 22, 26 is formed as one layer. However, the following configuration is also allowable. That is, two or more of each of the electrode layers 22, 26 are provided to sandwich the insulating layer therebetween, so that an area which is occupied in a planar direction on the semiconductor substrate 11 by the wiring pattern for connecting the drive circuit 40 and the heat generation units 20C, 20M, 20Y, and 20K, is made to be small. This configuration makes the size of the semiconductor substrate 11 (nozzle substrate 6) in the planar direction small, which results in the downsizing of the inkjet head 10.

In this embodiment, the formation position 41 of the drive circuit 40 on the semiconductor substrate 11 is provided not to overlap with the first corresponding position 67 and the second corresponding position 68 in the thickness direction. The drive circuit 40 may be formed at a position overlapping with at least one of the first corresponding position 67 and the second corresponding position 68. For example, the drive circuit 40 is formed on the semiconductor substrate 11, the heat generation resistant layer 21 and the electrode layers 22, 26 are formed on the upper layer of drive circuit 40, and via holes are provided in the thickness direction. The drive circuit 40 may be electrically connected to the wiring pattern formed by the electrode layers 22, 26 via the via holes. In the nozzle substrate 6 having the above configuration, the formation position 41 of the drive circuit 40 may be a position on the semiconductor substrate 11 immediately below the nozzle rows 62C, 62M, 62Y, and 62K, provided that the formation position 41 does not overlap with the formation positions of the ink openings 15C, 15M, 15Y, and 15K in the thickness direction. By letting the formation position 41 of the drive circuit 40 overlap with at least one of the first corresponding position 67 and the second corresponding position 68 on the semiconductor substrate 11, the size of the semiconductor substrate 11 (nozzle substrate 6) in the planar direction can be further reduced, which results in the downsizing of the ink-jet head 10.

Figure 6:
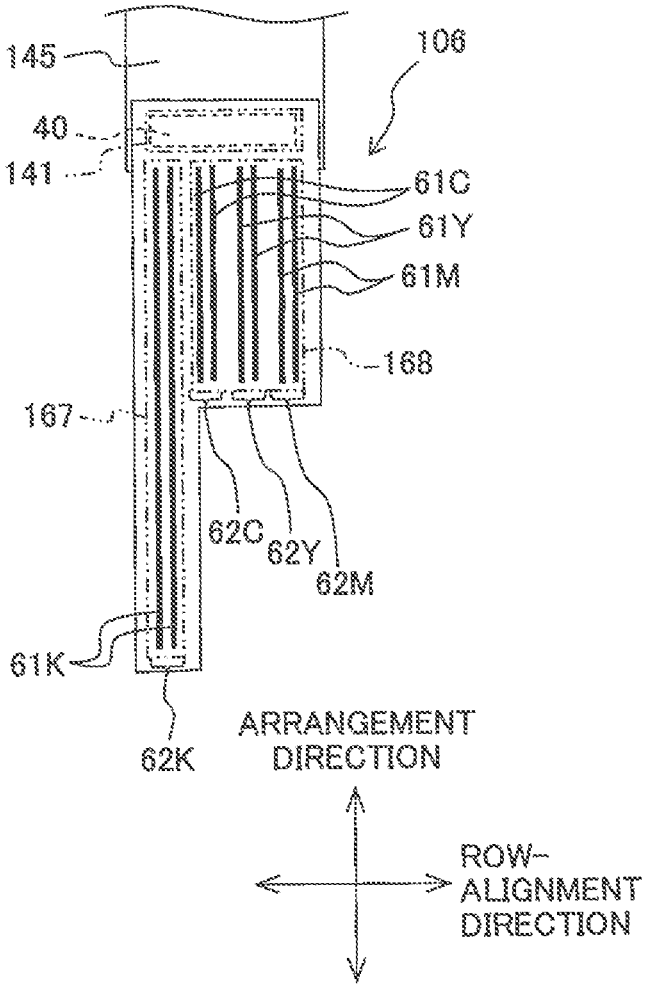
FIG. 6 depicts an embodiment of a nozzle substrate 106 as a modified embodiment.

The drive circuit 40 can be disposed at any position on the semiconductor substrate 11 of the nozzle substrate 6. For example, in a nozzle substrate 106 as depicted in FIG. 6, a first corresponding position 167 and a second corresponding position 168 are arranged adjacently to each other in the row-alignment direction on the semiconductor substrate (not depicted), the first corresponding position 167 being a position in which the nozzle rows 62K are formed, the second corresponding position 168 being a position in which the nozzle rows 62C, 62M, and 62Y are formed. The nozzle rows 62K and the nozzle rows 62C, 62M, and 62Y are arranged in a state that one ends of these rows in the arrangement direction are aligned. The drive circuit 40 is formed to extend in the row-alignment direction at a formation position 141 on the side of one end of the nozzle substrate 106 in the arrangement direction so as to be positioned closer to a FPC 145 than the first and second corresponding positions 167, 168. Also in this modified embodiment, the nozzle substrate 6 is formed to have a concave polygon shape in planar view along the contour line, which surrounds the area occupied by the first corresponding position 167, the second corresponding position 168, and the formation position 141 of the drive circuit 40. As a result, the nozzle substrate 106 in this modified embodiment has such a concave polygon shape that the length in the row-alignment direction is shorter than that of the nozzle substrate 6 and the length in the arrangement direction is longer than that of the nozzle substrate 6.

As described above, since the nozzle substrate 106 is configured that the drive circuit 40 is arranged adjacently to respective one ends of the nozzle rows 62C, 62M, 62Y, and 62K in the arrangement direction, it is possible to shorten the lengths of the wires of the wiring pattern formed by the electrode layers 22, 26, the wires connecting the drive circuit 40 and the heat generation units 20C, 20M, 20Y, and 20K respectively. Further, the FPC 145 which is connected to the drive circuit 40 can be connected to contact pads (not depicted) of the drive circuit 40 on the side of one end of the nozzle substrate 106 in the arrangement direction. This allows the FPC 145 to have a narrower width, which results in the downsizing of the carriage 4 and the inkjet printer 1. Further, the row-alignment direction of the nozzle substrate 106 corresponds to the scanning direction of the carriage 4. In this modified embodiment, the drive circuit 40 may be disposed on a side of respective other ends of the nozzle rows 62C, 62M, 62Y, and 62K in the arrangement direction.

In this modified embodiment, it is possible to shorten the distances between the nozzle rows 62K and the nozzle rows 62C, 62M, and 62Y in the row-alignment direction corresponding to the scanning direction. Thus, the nozzle substrate 106 can be formed to have a narrower width in the row-alignment direction, which results in the downsizing of the ink-jet head 10 incorporating the nozzle substrate 106. Further, the contact pads can be provided at one place on the side of one end of the semiconductor substrate 11 in the arrangement direction corresponding to the conveyance direction, the contact pads being disposed on the semiconductor substrate 11 to be connected to the connecting lines (not depicted) of the FPC 145 which connect the drive circuit 40 and the external circuit. Disposing the contact pads at one place makes the connection between the contact pads and the connecting lines of the FPC easy and secure, and allows the FPC 145 to have a narrower width. This results in the downsizing of the ink-jet head 10 incorporating the nozzle substrate 6 and the downsizing of the ink-jet printer 1. The smaller and lighter ink-jet head 10 can reduce the driving force required for moving the ink-jet head 10 in the scanning direction, which brings about the effects of electrical power saving, downsizing of the drive motor, and the like.

Figure 7:
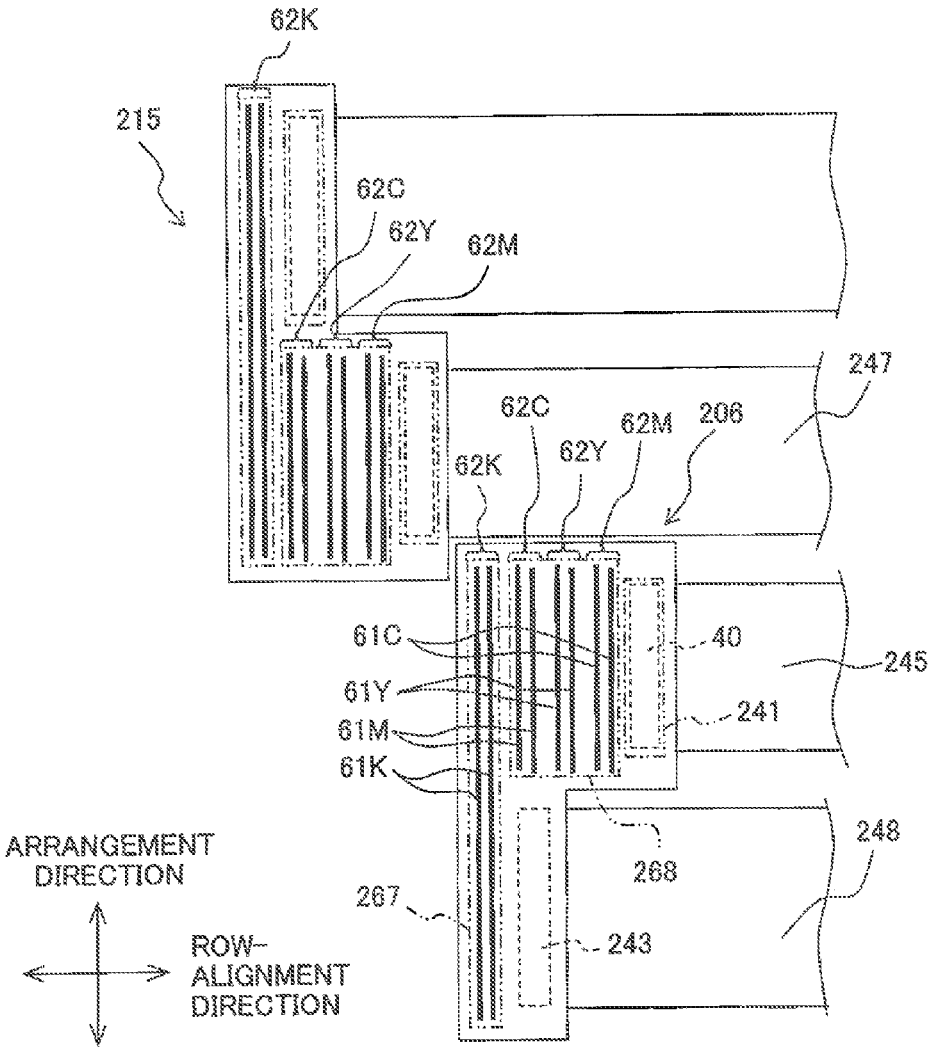
FIG. 7 depicts an embodiment of a nozzle substrate 206 as another modified embodiment.

In a nozzle substrate 206 depicted in FIG. 7, a first corresponding position 267 and a second corresponding position 268 are arranged adjacently to each other in the row-alignment direction on the semiconductor substrate (not depicted), and the nozzle rows 62K and the nozzle rows 62C, 62M, and 62Y are arranged in a state that one ends of these rows in the arrangement direction are aligned. In this case, the drive circuit 40 may be disposed to extend in the arrangement direction on the side of one end of the nozzle substrate 6 in the row-alignment direction so as to be positioned closer to a FPC 245 than the first and second corresponding positions 267, 268. Also in this modified embodiment, the nozzle substrate 206 is formed to have a concave polygon shape in planar view along the contour line, which surrounds the area occupied by the first corresponding position 267, the second corresponding position 268, and the formation position 241 of the drive circuit 40. The nozzle substrate 206 has the concave polygon shape which is substantially the same as that of the nozzle substrate 6.

As depicted in FIG. 7, the drive circuit 40 is disposed in the nozzle substrate 206 to be adjacent to the nozzle row 62M positioned outermost side in the row-alignment direction. Thus, the FTC 245 connected to the drive circuit 40 can be connected to the contact pads (note depicted) of the drive circuit 40 from the side of one end of the nozzle substrate 206 in the row-alignment direction. The nozzle substrate 206 having this configuration allows the FPC 245 connected to the nozzle substrate 206 to extend in the row-alignment direction. Further, a nozzle substrate 215 may be prepared, the nozzle substrate 215 being configured similarly to the nozzle substrate 206 and in which the nozzle rows 62K and the nozzle rows 62C, 62M, and 62Y are arranged in a state that one ends of these rows in the arrangement direction are aligned on the side, of one end of the nozzle substrate 215, closer to the nozzle substrate 206 (see FIG. 7). In this case, by arranging the nozzle substrates 206 and 215 to form an array in the arrangement direction and then incorporating them into the carriage 4, the printing can be performed over twice the length in the conveyance direction while the carriage 4 moves once in the scanning direction. This increases the printing speed. Since both of the FPC 245 connected to the nozzle substrate 206 and a FPC 247 connected to the nozzle substrate 215 extend in the row-alignment direction, they do not intersect each other. Therefore, the FPCs 245 and 247 can be installed to the carriage 4 easily, which is preferable.

In the nozzle substrate 206 of this modified embodiment, it is possible to shorten distances between the drive circuit 40 and the nozzle ports 61K or distances between the drive circuit 40 and the nozzle ports 61C, 61M, and 61Y. Thus, it is possible to shorten the lengths of wires in the wiring pattern formed by the electrode layers 22, 26, the wires electrically connecting the drive circuit 40 and the heat generation units 20K on the semiconductor substrate 11 or electrically connecting the drive circuit 40 and the heat generation units 20C, 20M, and 20Y on the semiconductor substrate 11. This configuration can reduce the conduction resistance in the electrode layers 22, 26. Therefore, the signal for jetting the black ink which is outputted to the heat generation units 20K by the drive circuit 40 or the signal for jetting each of the inks of cyan, magenta, and yellow which is outputted to one of the heat generation units 20C, 20M, and 20Y by the drive circuit 40 is prevented from deteriorating. As a result, each of the inks can be discharged with high accuracy without, for example, the delay of waveform of the signal.

In the modified embodiment depicted in FIG. 7, for example, a plurality of contact pads 243 for connecting the drive circuit 40 and the FPC 248 may be provided at a position which is adjacent to the first corresponding position 267 in the row-alignment direction and which does not overlap with the second corresponding position 268 in the arrangement direction. In this configuration, the external circuit and the drive circuit 40 are connected via two FPCs 245 and 248 by use of more connecting lines. Using more connecting lines increases an amount of data which can be sent and received between the external circuit and the drive circuit 40 per unit time, which increases the printing speed. Instead of using the contact pads 243, the following configuration may be adopted to downsize the nozzle substrate 6. That is, the configuration of the drive circuit 40 in this modified embodiment is distributed over two positions or places to reduce the size of the drive circuit 40 in the row-alignment direction.

Alternatively, in the modified embodiment depicted in FIG. 7, the drive circuit 40 may be disposed to extend in the arrangement direction on the side of the other end of the nozzle substrate 6 in the row-alignment direction so as to be positioned away from the FPC 245 further than the first and second corresponding positions 267, 268. In this case, in the nozzle substrate 206, the drive circuit 40 is configured to have a longer length in the arrangement direction than that of the configuration depicted in FIG. 7. Thus, even though the length of the drive circuit 40 in the row-alignment direction is shortened, it is possible to secure a sufficient area where components of the drive circuit 40 are disposed. This can reduce the size of the drive circuit 40 in the row-alignment direction.

Figure 8:
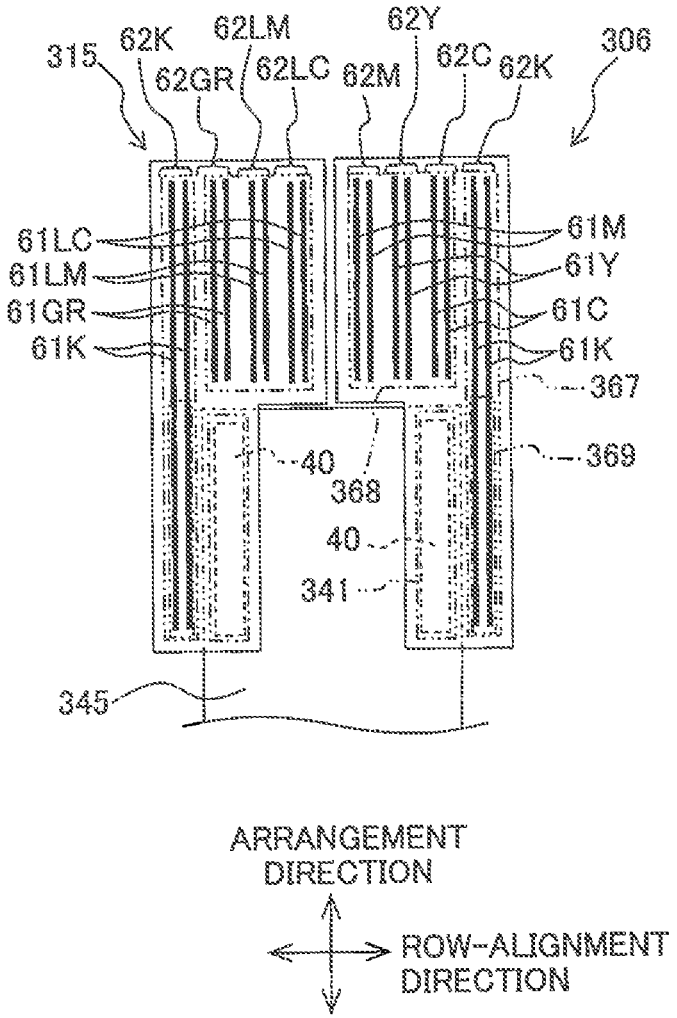
FIG. 8 depicts an embodiment of a nozzle substrate 306 as still another modified embodiment.

In a nozzle substrate 306 depicted in FIG. 8, a first corresponding position 367 and a second corresponding position 368 are placed to be adjacent to each other in the row-alignment direction on the semiconductor substrate (not depicted), and the nozzle rows 62K and the nozzle rows 62C, 62M, and 62Y are arranged in a state that one ends of these rows in the arrangement direction are aligned. A part, of the first corresponding position 367, which does not overlap with the second corresponding position 368 in the arrangement direction is referred to as a third corresponding position 369. In this case, the drive circuit 40 may be disposed to extend in the arrangement direction on the side of one end of the nozzle substrate 306 in the row-alignment direction so as not to overlap with the third corresponding position 369. Also in this modified embodiment, the nozzle substrate 306 is formed to have a concave polygon shape in planar view along the contour line, which surrounds the area occupied by the first corresponding position 367, the second corresponding position 368, and a formation position 341 of the drive circuit 40. As a result, the nozzle substrate 306 in this modified embodiment has the concave polygon shape which is substantially the same as that of the nozzle substrate 6.

In the nozzle substrate 306, the heat generation units 20C, 20M, 20Y, and 20K are compactly arranged in the first corresponding position 367 except the third corresponding position 369 and the second corresponding position 368, and only the heat generation units 20K are arranged in the third corresponding position 369. Thus, a temperature gradient is caused on the semiconductor substrate due to the difference in arrangement density of the heat generation units 20C, 20M, 20Y, and 20K. The temperature gradient causes the difference in temperature between the black ink jetted from the nozzle ports 61K arranged in the third corresponding position 369 and the black ink jetted from the nozzle ports 61K arranged in the first corresponding position 367 except the third corresponding position 369, to non-uniformly change property values of the ink such as surface tension and a viscosity coefficient. This could vary discharge characteristics of the ink (discharge speed, volume of ink droplet, and the like). In view of the above, the drive circuit 40 is disposed at a position adjacent, in the row-alignment direction, to the third corresponding position 369 where only the nozzle ports 61K for the black ink are formed. In the nozzle substrate 306 having this configuration, the sum of the amount of heat generation associated with the drive of the drive circuit 40 and the amount of heat generation of the heat generation units 20K arranged in the third corresponding position 369 can approximate the sum of amounts of heat generation of the heat generation units 20C, 20M, 20Y, and 20K arranged in the first corresponding position 367 except the third corresponding position 369 and the second corresponding position 368. Accordingly, in the nozzle substrate 306, the temperature gradient on the semiconductor substrate due to the difference in arrangement density of the heat generation units 20C, 20M, 20Y, and 20K can be lowered, and thereby making it possible to prevent the variation in discharge characteristics.

In this modified embodiment, the position, where the nozzle ports 61C, 61M, 61Y, and 61K are arranged in rows in the arrangement direction corresponding to the conveyance direction to form respective nozzle rows placed to be parallel to each other in the row-alignment direction corresponding to the scanning direction, has higher nozzle density and larger amount of heat generation associated with the drive of the heart generation units 20C, 20M, 20Y, and 20K than the position where only the nozzle ports 61K are arranged. In view of the above, the drive circuit 40 is provided on the semiconductor substrate 11 in the vicinity of the third corresponding position 369 where only the nozzle ports 61K are arranged, so that the amount of heat generation of the drive circuit 40 compensates the amount of heat generation of the heat generation units 20K in the third corresponding position 369. This can uniformize the heat influence on the ink caused by the heat generation of the drive circuit 40 and the heat generation units 20C, 20M, 20Y, and 20K, thereby making it possible to discharge the black ink from any of the nozzle ports 61K with high accuracy.

In the modified embodiment of FIG. 8, it is allowable to prepare a nozzle substrate 315 which is configured similarly to the nozzle substrate 306 and in which nozzle rows 62K and nozzle rows 62LC, 62LM, and 62GR are arranged in a state of inverting the arrangement of the nozzle substrate 306 in the row-alignment direction. In the nozzle substrate 315, the nozzle rows 62K and the nozzle rows 62LC, 62LM, and 62GR are arranged in a state that one ends of these rows in the arrangement direction are aligned. A plurality of nozzle ports 61LC, 61LM, and 61GR forming the nozzle rows 62LC, 62LM, and 62GR respectively are provided to allow color inks of light cyan (LC), light magenta (LM), and gray (GR) to be discharged therefrom, respectively.

The nozzle substrates 306 and 315 are arranged to be adjacent to each other in the row-alignment direction to be connected to contact pads (not depicted) of respective drive circuits 40 via a FPC 345, and the nozzle substrates 306 and 315 are incorporated in the carriage 4. The black ink can be discharged from two nozzle rows 62K while the carriage 4 moves once in the scanning direction. Thus, in the inkjet printer 1, by letting the drive circuit 40 perform the control for landing black ink droplets on landing positions of the recording sheet P alternatingly, the scanning operation can be performed by the carriage 4 at double the speed at the time of printing by use of the black ink. This increases the printing speed. Further, since the nozzle substrate 315 includes the nozzle ports 62LC, 62LM, and 62GR, the ink-jet printer 1 can perform the printing of high image quality and sufficient color reproducibility by using the inks of six colors.

In the modified embodiment depicted in FIG. 8, the construction of respective inks in the nozzle substrate 315 may be the same as that in the nozzle substrate 306. In this case, the following configuration is allowable. That is, in a case that the carriage 4 moves to one side in the scanning direction, each of the inks is discharged from each of the nozzle ports in the nozzle substrate 306; in a case that the carriage 4 moves to the other side in the scanning direction, each of the inks is discharged from each of the nozzle ports in the nozzle substrate 315.

Figure 9:
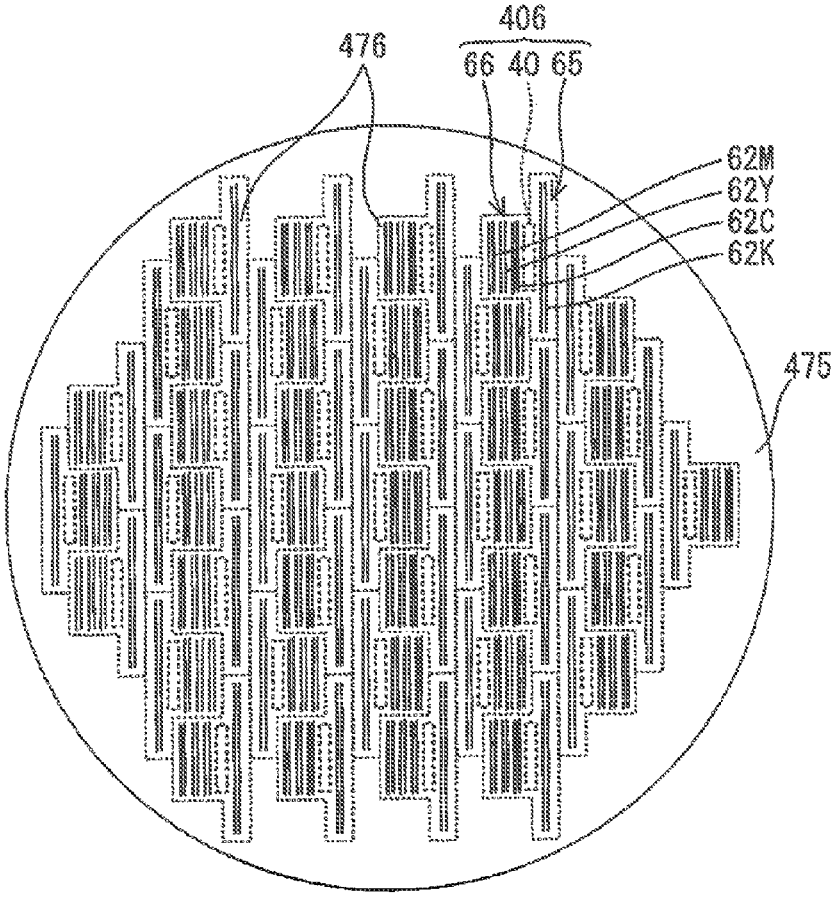
FIG. 9 depicts an embodiment of a nozzle substrate 406 as yet another modified embodiment.

In the above embodiment and modified embodiments, the nozzle rows 62K and the nozzle rows 62C, 62M, and 62Y are arranged in a state that one ends of these rows in the arrangement direction are aligned. The present teaching is not limited to this configuration, and the nozzle rows 62K and the nozzle rows 62C, 62M, and 62Y may be arranged to have any positional relation. For example, as depicted in FIG. 9, it is allowable to make a nozzle substrate 406 in which nozzle rows 62C, 62M, and 62Y are arranged at an intermediate part of the nozzle rows 62K in the arrangement direction. In this case, in the manufacturing process of the nozzle substrate 406, the shape of each die 476 formed on a wafer 475 of the semiconductor substrate is made to have a concave polygon shape in which the color nozzle unit 66 protrudes, in the row-alignment direction, from the substantially center part of the black nozzle unit 65 in the arrangement direction. The dies 476 are arranged in the form of blocks with no space therebetween. The number of dies 476 which can be obtained from one wafer 475 can be increased by using the nozzle substrate 406 having this shape.

Figure 10:
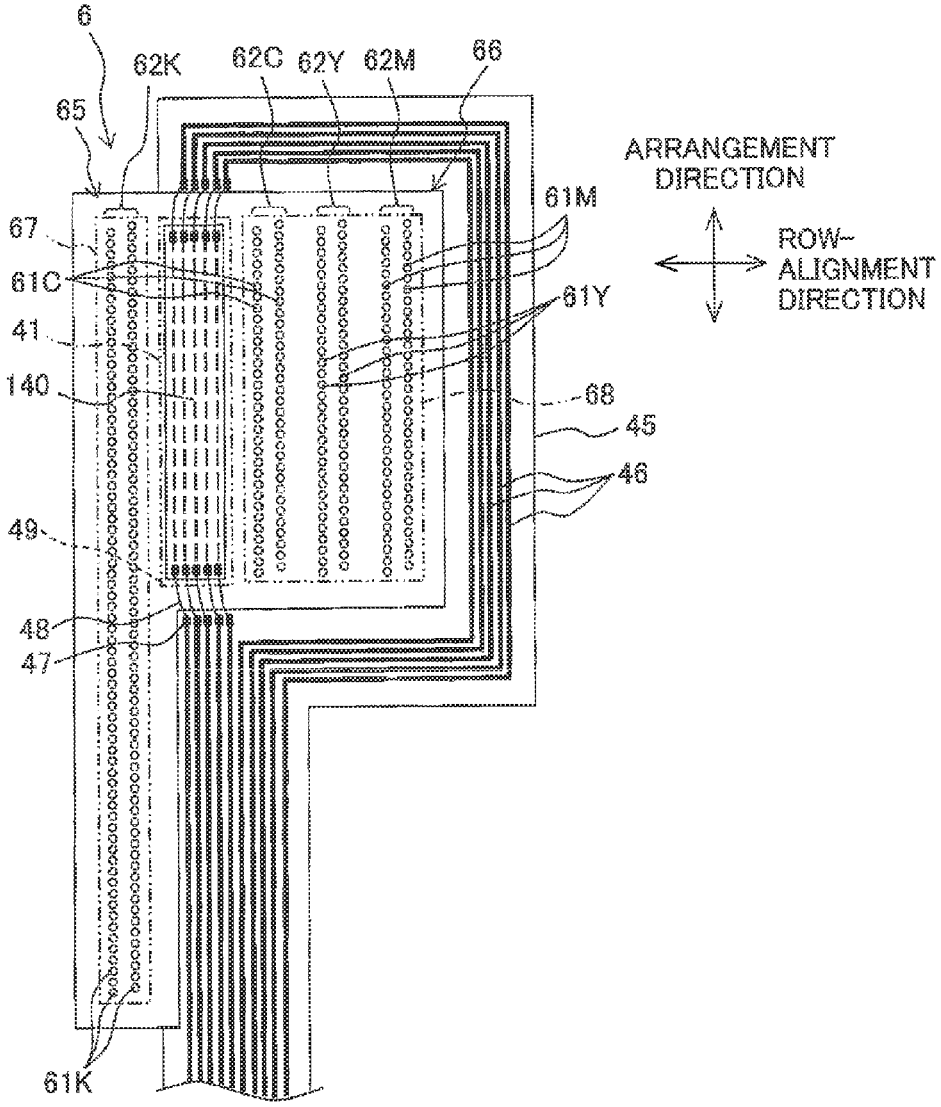
FIG. 10 depicts a schematic configuration of an ink-jet head in which connection terminals 140 are provided instead of a drive circuit 40.

In the above embodiment and modified embodiments, the drive circuit 40 is formed on the semiconductor substrate 11 as an exemplary electrical element which is electrically connected to the heat generation units 20K and the heat generation units 20C, 20M, and 20Y. The present teaching, however, is not limited to this. It is not necessarily indispensable to provide the drive circuit 40 on the semiconductor substrate 11. For example, the drive circuit 40 may be provided on another substrate which is different from the semiconductor substrate 11. As depicted in FIG. 10, the following configuration is allowable. That is, connection terminals 140 are provided on the semiconductor substrate 11 so that the drive circuit 40 provided on another substrate is connected to the connection terminals 140 on the semiconductor substrate 11 via a wiring member 141 such as the FPC. In this case, the connection terminals 140 correspond to electrical elements electrically connected to the heat generation units 20K and the heat generation units 20C, 20M, and 20Y.

Figure 11A:
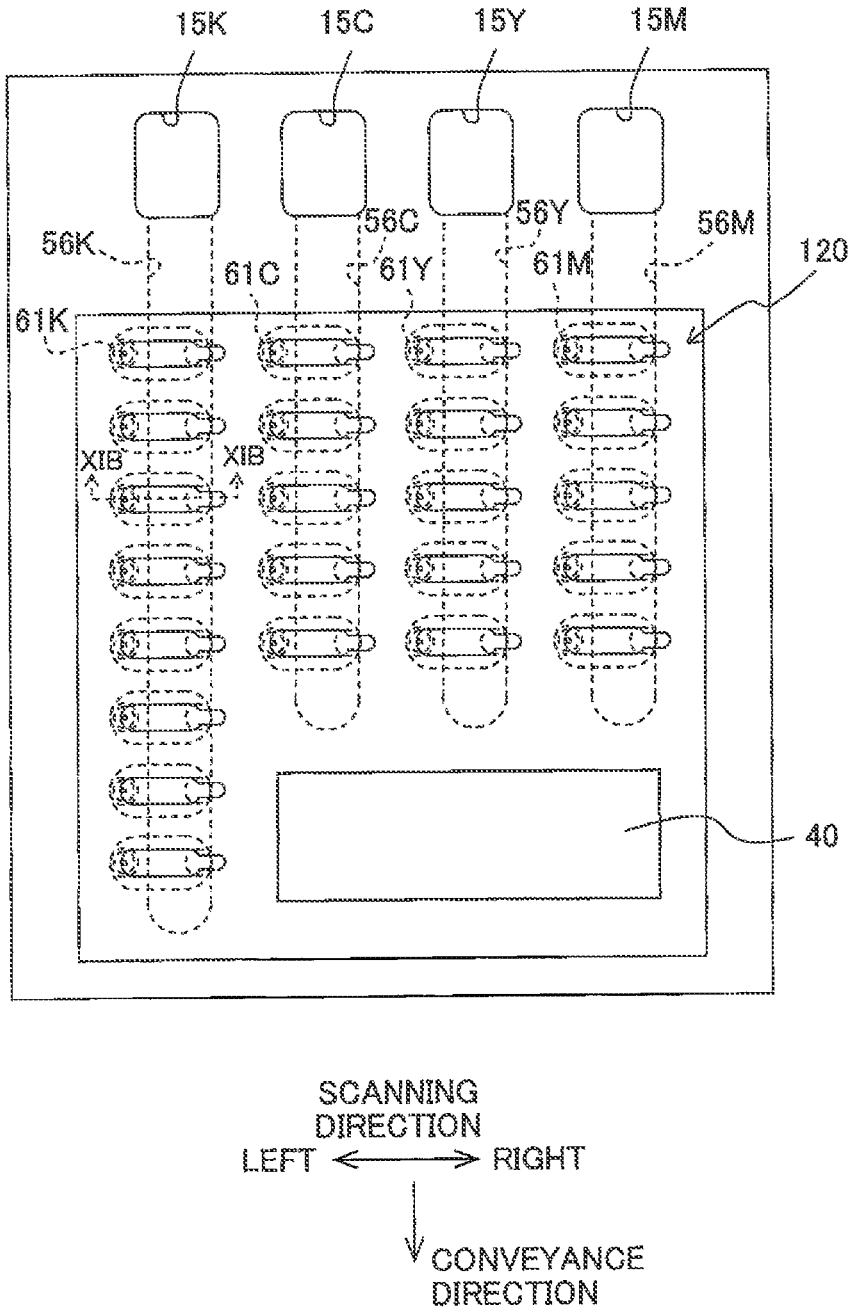
FIGS. 11A and 11B depict a schematic configuration of an ink-jet head in which piezoelectric actuators 120 are provided instead of heat generation units 20C, 20M, 20Y, and 20K.
Figure 11B:
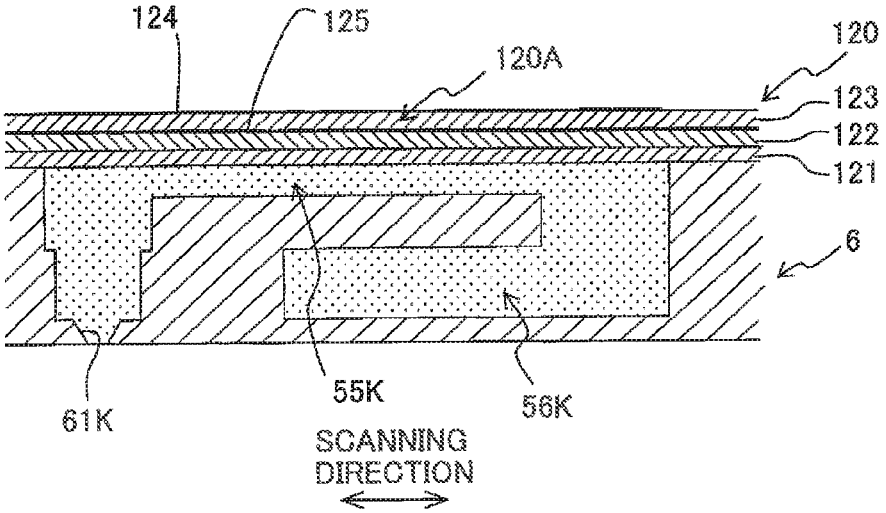

The ink-jet head 10 including the nozzle substrate 6 is a liquid discharge head of the thermal type as follows. That is, respective inks of cyan, magenta, yellow, and black are heated by the heat generation units 20C, 20M, 20Y, and 20K and discharged from the nozzle ports 61C, 61M, 61Y, and 61K respectively under the influence of bubbles generated in the inks. The present teaching, however, is not limited thereto. For example, as depicted in FIGS. 11A and 11B, the ink-jet head 10 may be a piezo liquid discharge head as follows. That is, piezoelectric actuators 120 converting voltage into force are provided instead of the heat generation units 20C, 20M, 20Y, and 20K, and respective inks of cyan, magenta, yellow, and black are conductively pressurized to be discharged from the nozzle ports 61C, 61M, 61Y, and 61K respectively. As depicted in FIGS. 11A and 11B, the piezoelectric actuator 120 includes a vibration plate 121, piezoelectric layers 122 and 123, a plurality of individual electrodes 124, and a common electrode 125. The vibration plate 121 is joined to the upper surface of the nozzle substrate 6 in a state of covering the plurality of ink chambers 55K, 55C, 55M, and 55Y. The common electrode 125 is arranged between the two piezoelectric layers 122 and 123, to be spread over the plurality of ink chambers 55K, 55C, 55M, and 55Y. A portion of the upper piezoelectric layer 123 sandwiched between the individual electrode 124 and the common electrode 125 is called as an active portion 120A, and is polarized in a direction of thickness of the piezoelectric layer 123. The active portion 120A contracts when there is an electric potential difference between the individual electrode 124 and the common electrode 125, and causes a bending deformation of the vibration plate 121. As the drive signal is supplied from the drive circuit 40 to a certain individual electrode 124, a piezoelectric distortion occurs in the active portion 120A sandwiched between the individual electrode 124 and the common electrode 125, and the vibration plate 121 is deformed to be bent toward the ink chambers 55K, 55C, 55M, and 55Y. At this time, a volume of the ink chambers 55K, 55C, 55M, and 55Y is changed to be decreased. Accordingly, a pressure is applied to the ink inside the ink chambers 55K, 55C, 55M, and 55Y, and the ink is jetted from the nozzle 26. The nozzle substrate 6 includes the semiconductor substrate.

The inkjet head 10 of the present teaching is provided with the nozzle substrate 6 configured so that respective inks of cyan, magenta, yellow, and black are discharged. The inkjet head 10, however, may be configured so that not only the inks but also other liquids such as organic EL material, a reagent for DNA analysis, and shaping liquid for a 3D printer are discharged. Further, the color nozzle unit 66 of the nozzle substrate 6 of the present teaching includes the nozzle rows 62C, 62M, and 62Y from which the inks of three colors of cyan, magenta, and yellow are discharged respectively. The present teaching, however, is not limited to this. The color nozzle unit 66 may include nozzle rows from which one color ink is discharged or nozzle rows from which a plurality of colors of inks (for example, inks having five colors of cyan, magenta, yellow, light cyan, and light magenta) are discharged respectively.

In the above embodiment, the inkjet head 10 corresponds to "liquid discharge head" of the present teaching; the black ink corresponds to "first liquid" of the present teaching; the cyan, magenta, yellow inks correspond to "second liquid" of the present teaching; the nozzle ports 61K correspond to "first nozzles" of the present teaching; the nozzle ports 61C, 61M, and 61Y correspond to "second nozzles" of the present teaching; the ink channel 56K communicating with the ink chambers 55K corresponds to "first liquid channel" of the present teaching; the ink channels 56C, 56M, and 56Y communicating with the ink chambers 55C, 55M, and 55Y respectively correspond to "second liquid channel" of the present teaching; the heat generation units 20K correspond to "first energy applying mechanisms" of the present teaching; the heat generation units 20C, 20M, and 20Y correspond to "second energy applying mechanisms" of the present teaching; the nozzle row 62K corresponds to "first nozzle row" of the present teaching; and the nozzle rows 62C, 62M, and 62Y correspond to "second nozzle row" of the present teaching.

What is claimed is:

1. A liquid discharge head configured to discharge liquid to a medium comprising:

a nozzle substrate formed integrally with a semiconductor substrate as a base, and in which a first liquid channel and a second liquid channel are formed, the first liquid channel being disposed inside the nozzle substrate to communicate with a plurality of first nozzles from which a first liquid supplied from a liquid supply source is discharged, the second liquid channel being disposed inside the nozzle substrate to communicate with a plurality of second nozzles from which a second liquid different from the first liquid and supplied from the liquid supply source is discharged;

a plurality of first energy applying mechanisms provided in the first liquid channel to correspond to the first nozzles respectively on the semiconductor substrate and configured to apply energy to discharge the first liquid from the first nozzles to the first liquid;

a plurality of second energy applying mechanisms provided in the second liquid channel to correspond to the second nozzles respectively on the semiconductor substrate and configured to apply energy to discharge the second liquid from the second nozzles to the second liquid; and an electrical element provided on the semiconductor substrate to be electrically connected to the first energy applying mechanisms and the second energy applying mechanisms;

wherein the first nozzles are arranged in an arrangement direction to form a first nozzle row and the second nozzles are arranged in the arrangement direction to form a second nozzle row in the nozzle substrate;

wherein the first nozzle row and the second nozzle row are arranged side by side in a row-alignment direction perpendicular to the arrangement direction;

wherein a length of the first nozzle row in the arrangement direction is longer than a length of the second nozzle row in the arrangement direction; and wherein the electrical element is provided on the semiconductor substrate at a position which does not overlap with a first corresponding position and a second corresponding position, the first corresponding position being a position, on the semiconductor substrate, which corresponds to a position in which the first nozzle row is formed in a thickness direction perpendicular to the arrangement direction and the row-alignment direction, the second corresponding position being a position, on the semiconductor substrate, which corresponds to a position in which the second nozzle row is formed in the thickness direction.

2. The liquid discharge head according to claim 1;

wherein the electrical element is a drive circuit to drive the first and second energy applying mechanisms.

3. The liquid discharge head according to claim 1;

wherein the electrical element is provided on the semiconductor substrate at a position between the first corresponding position and the second corresponding position in the row-alignment direction.

4. The liquid discharge head according to claim 1;

wherein the first and second nozzle rows are disposed in the nozzle substrate so that respective one ends of the first and second nozzle rows in the arrangement direction are aligned; and wherein the electrical element is provided on the semiconductor substrate at a position which is closer to one end side of the nozzle substrate in the arrangement direction than the first and second corresponding positions.

5. The liquid discharge head according to claim 1;

wherein the electrical element is provided on the semiconductor substrate at a position which is closer to one end side or the other end side of the nozzle substrate in the row-alignment direction than the first and second corresponding positions.

6. The liquid discharge head according to claim 1;

wherein the first nozzle row is disposed at a position which is closer to one end side of the nozzle substrate in the row-alignment direction than the second nozzle row; and wherein the electrical element is provided on the semiconductor substrate at a position which is closer to the other end side of the nozzle substrate in the row-alignment direction than a third corresponding position, the third corresponding position being a position, on the semiconductor substrate, which corresponds, in the thickness direction, to a position in which there are formed first nozzles, of the first nozzles constituting the first nozzle row, disposed closer to one end side or the other end side of the nozzle substrate in the arrangement direction than ends of the second nozzle row in the arrangement direction.

7. The liquid discharge head according to claim 1;

wherein an outer shape or contour of the nozzle substrate as viewed in a plan view perpendicular to the thickness direction is a shape along a contour line, which surrounds an area occupied by the first corresponding position, the second corresponding position, and a position at which the electrical element is formed.

8. The liquid discharge head according to claim 1;

wherein the electrical element are connection terminals electrically connected to the first and second energy applying mechanisms.

9. The liquid discharge head according to claim 8;

wherein the electrical element is electrically connected to a driving circuit provided on a substrate which is different from the nozzle substrate via a wiring element.

10. The liquid discharge head according to claim 1;

wherein the second nozzle row is arranged at an intermediate part of the first nozzle row in the arrangement direction so that both ends of the second nozzle row are not aligned with both ends of the first nozzle row in the arrangement direction.

11. The liquid discharge head according to claim 1;

wherein the electrical element is provided on the semiconductor substrate at a position opposite to the first corresponding position with respect to the second corresponding direction, in the row-alignment direction.

* * * * *